US005555761A

United States Patent [19]

Lavy

[11] Patent Number: 5,555,761

[45] Date of Patent: Sep. 17, 1996

[54] BODYMAKER TOOL PACK

[76] Inventor: Roderick A. Lavy, 6865 Alexander Dr., Piqua, Ohio 45356

[21] Appl. No.: 453,193

[22] Filed: May 30, 1995

[51] Int. Cl.[6] ..... B21D 22/00; B21B 25/00

[52] U.S. Cl. ..... 72/349; 72/347; 72/465; 72/456

[58] Field of Search ..... 72/347, 349, 456, 72/465, 467, 72

[56] References Cited

U.S. PATENT DOCUMENTS

| | | | |
|---|---|---|---|
| 1,720,375 | 7/1929 | Parker . | |
| 3,496,756 | 2/1970 | Smith | 72/432 |
| 3,653,249 | 4/1972 | Dunn | 72/349 |
| 3,715,902 | 2/1973 | Fuchs | 72/60 |
| 3,800,583 | 4/1974 | Miller | 72/349 |
| 3,943,740 | 3/1976 | Bartenstein | 72/349 |
| 3,986,382 | 10/1976 | Miller | 72/347 |
| 4,020,670 | 5/1977 | Bulso, Jr. et al. | 72/349 |
| 4,038,859 | 8/1977 | Pavleszek | 72/347 |
| 4,148,208 | 4/1979 | Maeder | 72/342 |
| 4,173,882 | 11/1979 | Lee | 72/349 |
| 4,217,770 | 8/1980 | Wassen | 72/349 |
| 4,223,544 | 9/1980 | Main | 72/45 |
| 4,300,375 | 11/1981 | Maeder | 72/45 |
| 4,407,149 | 10/1983 | Smith | 72/47 |
| 4,541,265 | 9/1985 | Dye | 72/349 |
| 4,554,815 | 11/1985 | Weishalla | 72/349 |
| 4,562,720 | 1/1986 | Nishikawa | 72/349 |
| 4,578,981 | 4/1986 | Nishikawa | 72/347 |
| 4,779,442 | 10/1988 | Welsh | 72/347 |
| 4,852,377 | 8/1989 | Mikas | 72/349 |
| 4,996,865 | 3/1991 | Haulsee | 72/349 |
| 5,020,350 | 6/1991 | Knepp | 72/45 |
| 5,168,742 | 12/1992 | Heyes | 72/279 |
| 5,272,901 | 12/1993 | Cudzik | 72/348 |

*Primary Examiner*—Lowell A. Larson
*Assistant Examiner*—Rodney Butler
*Attorney, Agent, or Firm*—Randall J. Knuth

[57] ABSTRACT

A bodymaker tool pack including a plurality interleaved ironing and spacer rings through which a ram or punch forces a workpiece to redraw a metal can body. Hydrostatic pads are created between the punch and spacer rings to effectively guide the punch through the tool pack. Additionally, the ironing and spacer rings are themselves supported by hydrostatic pressure pads formed within the tool pack housing.

22 Claims, 4 Drawing Sheets

BODYMAKER TOOL PACK

BACKGROUND OF THE INVENTION

The present invention relates generally to mechanical bodymaker machines and in particular to metal can producing bodymaker tool packs utilizing a punch or ram to iron the cup into a can body.

In prior art drawing presses or bodymakers, the ram or punch is generally oriented horizontally such as in U.S. Pat. No. 3,496,756. In forming beverage cans, a cup is placed on the end of a punch which is then forced through a plurality of ironing rings each smaller than a previous one so that the cup is redrawn, making it thinner and longer into substantially the shape of a standard beverage can body. The '756 patent utilizes a scotch yoke type mechanism driving a piston horizontally for blanking or drawing container bodies. A disadvantage of this design structure for a bodymaker is that, in punches with longer draws, the end is cantilevered thereby allowing inertial forces and gravity to vary the uniformity of the cup wall thickness formed thereby. Gravity acts on the cantilevered end forcing the male punch closer to one side of the female die and further away to an opposite side thereby causing the cup wall thickness to be thin on one side and thick on an opposite side. It is foreseeable that the inertia of the punch itself may cause unacceptable changes in wall thickness within the tool pack.

U.S. Pat. Nos. 5,272,901 and 3,715,902 show vertical type punches operated by either a combination crankshaft/cam drive system or by hydraulic pressure. These types of presses are unbalanced and their designs do not take into consideration inertial loads or thermal stress with regard to the accuracy of the container body produced. These types of structures would create container bodies of questionable accuracy with the currently desired production levels of 400 to 600 strokes per minute with and 18 to 24 inch punch stroke length.

The present invention is directed to fill the needs and overcome the aforementioned problems associated with the mechanical bodymaker machines where it is desired to accurately control the punch while the machine is in operation by controlling and counteracting inertial and vibratory forces on the punch.

SUMMARY OF THE INVENTION

The present invention provides unique hydrostatic guiding of the ram or punch within the tool pack. By forming a free floating punch, and in the preferred form of the invention, a vertical punch, more accurate placement of the punch and redrawing of the cup is accomplished.

The punch of the bodymaker hydrostatically floats within the tool pack between circumferentially spaced hydrostatic pads created within the housing and the guiding ironing rings. The hydrostatic pads keep the punch square and true within the tool pack. Additionally each of the ironing rings and spacer rings are themselves hydrostatically supported within the tool pack housing.

Known drive units may be utilized to drive the punch but preferably the one shown in the co-pending U.S. application Ser. No. 08/493,934, entitled "BODYMAKER DRIVE SYSTEM", assigned to the assignee of the present application is utilized. In that application, an under-drive vertical machine is disclosed with two counterrotating cranks geared together to balance the inertial forces acting on the machine. A scotch yoke mechanism is employed to drive the punch.

Counterweights attached to the counterrotating crankshafts further balance the mechanism.

Design speeds of 250 to 400 strokes per minute with a stroke length of 18 to 24 inches are possible with all of the inertial and rotating forces balanced.

Another advantage of the bodymaker tool pack of the present invention is that by totally guiding the ram or punch within hydrostatic pads, heat produced by friction is reduced thereby reducing the risk of warping the cups or finished metal cans. The added lubrication created by the hydrostatic pads allows the punch to reciprocate in a straighter and more controlled movement.

An additional advantage of the bodymaker tool pack of the present invention is that the ironing rings within the tool pack housing, the punch moving through the ironing rings, and spacer rings between the ironing rings are all hydrostatically supported and centered within the tool pack housing. By utilizing hydrostatic pads on the outside of the punch, the cup or workpiece is additionally kept cooler during the redrawing process.

The invention, in one form thereof, comprises a bodymaker tool pack having a housing in which is disposed plurality of interleaved ironing and spacer rings. A punch reciprocates through both the ironing and spacer rings to redraw the cup. Hydrostatic bearings are formed within the ironing rings to guide the punch during its reciprocation.

The invention, in accordance with another aspect thereof, comprises additional hydrostatic bearings disposed about the outside of the ironing rings and spacer rings to align the rings within the tool pack housing.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
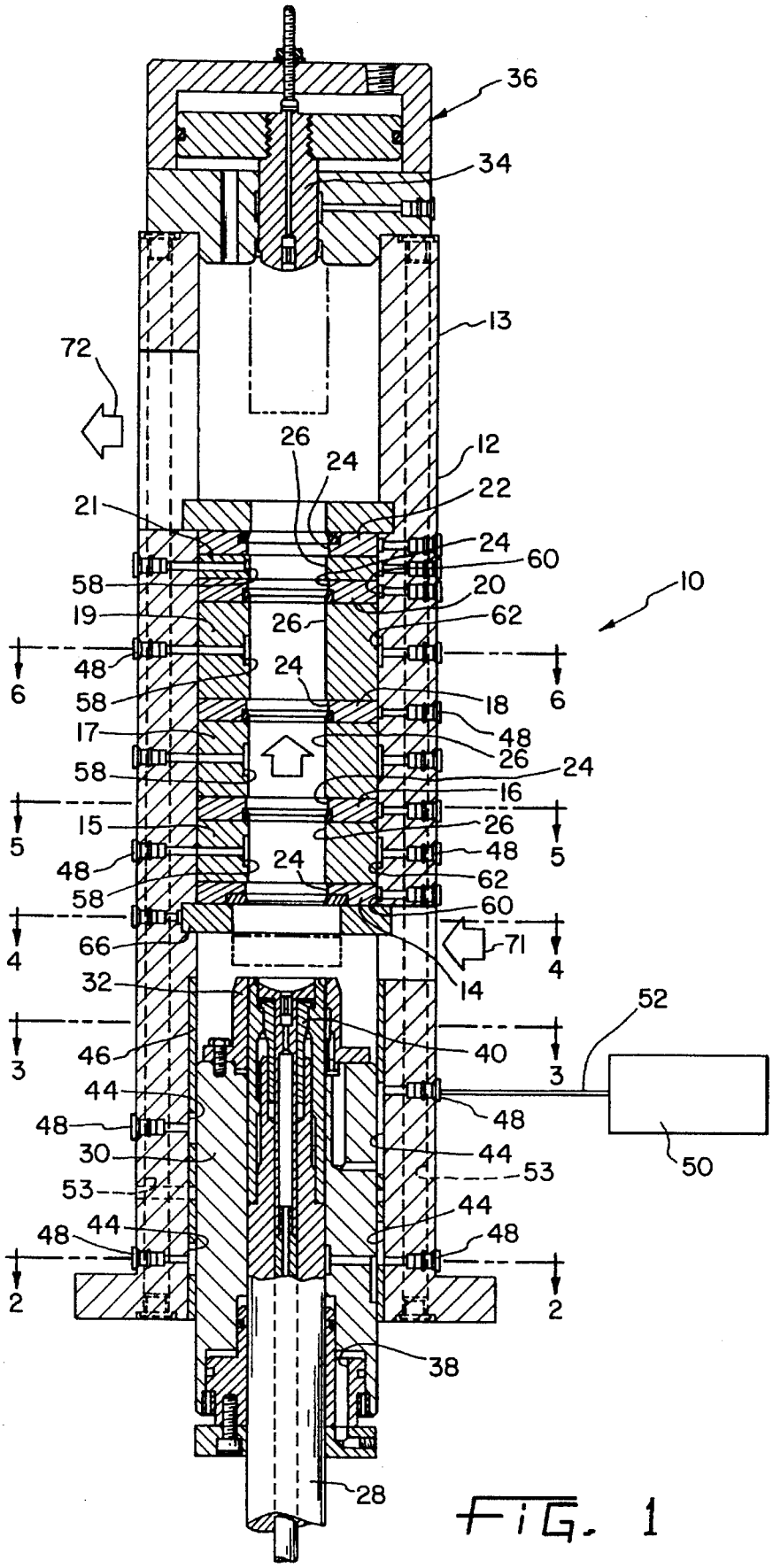
FIG. 1 is a longitudinal sectional view of the bodymaker tool pack apparatus in accordance with a preferred form of the present invention.

Referring now to FIG. 1, a blank or cup ironing bodymaker tool pack 10 is shown comprising a housing 12, having a sidewall 13, in which are disposed a plurality of ironing rings 14, 16, 18, 20 and 22 interleaved with spacer rings 15, 17, 19 and 21 respectively.

Each ironing ring includes a bore 24 coaxially aligned, while each spacer ring includes a sidewall forming a bore 26, the bores 26 coaxially aligned together and with ironing ring bores 24. A punch or ram 28 is associated with tool pack 10 to reciprocate through bores 24 and 26 to force through and redraw a workpiece in the form of a cup (not shown). The inner dimensions of ironing rings 14–22 cause the cup or workpiece to be thinned out and formed into substantially the shape of a standard metal can such as a beverage can as is well known in the art.

As shown in FIG. 1 additional mechanisms may be included in tool pack 10 such as a redraw pressure pad 30 and cup seater 32 connected to punch 28, and domer 34 located at in a top portion 36 of tool pack housing 12. A hydraulic chamber 38 may be disposed between punch 28 and pressure pad 30 to cause relative movement therebetween when pressurized hydraulic fluid is communicated from a source (not shown) into hydraulic chamber 38.

A domer piston 40 is located within the distal end of punch 28 to assist in creating the bottom contour of the can body in conjunction with domer 34 when punch 28 has moved to top dead center within tool pack housing 12. Domer piston 40 may be hydraulically linked and actuated through punch 28 via hydraulic pressure or alternatively mechanically actuated.

Punch 28 is reciprocated through tool pack 10 by means of a punch drive, preferably the one shown in the aforementioned co-pending application Ser. No. 08/493,934 assigned to the assignee of this patent and hereby explicitly incorporated by reference, although other punch drives may be utilized. In the aforementioned application, an under-drive vertical machine utilizes a scotch yoke drive arrangement to reciprocate the punch with reduced-vibration.

Use of a scotch yoke mechanism eliminates second harmonic vibrations caused by the particularly long throw of the punch. Additionally, counterrotating crankshafts may be utilized to balance out the rotational inertia of the bodymaker drive. By vertically reciprocating punch 28, as compared to prior art horizontal mountings, a balance of all side forces acting on the punch may be obtained during high speed reciprocation.

The present invention incorporates the use of hydrostatic pressure pads within the tool pack housing 12 to center the cup and punch 28. Additionally hydrostatic pressure pads are also formed and utilized to center both ironing rings (14, 16, 18, 20, 22) and spacer rings (15, 17, 19, 21) with tool pack housing 12.

Figure 2:
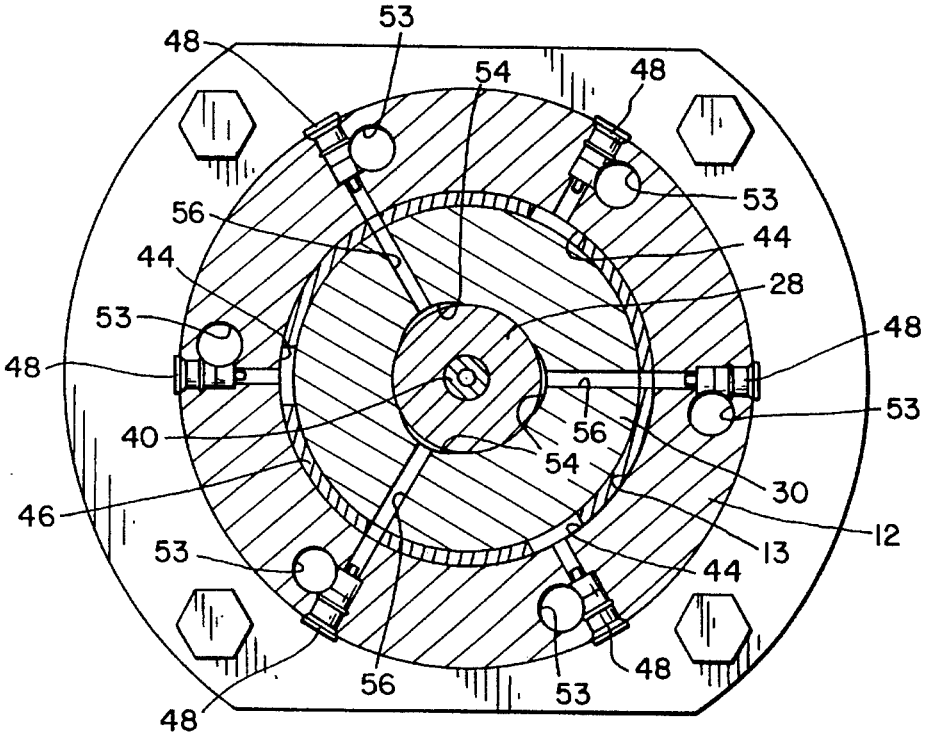
FIG. 2 is a sectional view taken along line 2—2 of FIG. 1 and viewed in the direction of the arrows.
Figure 3:
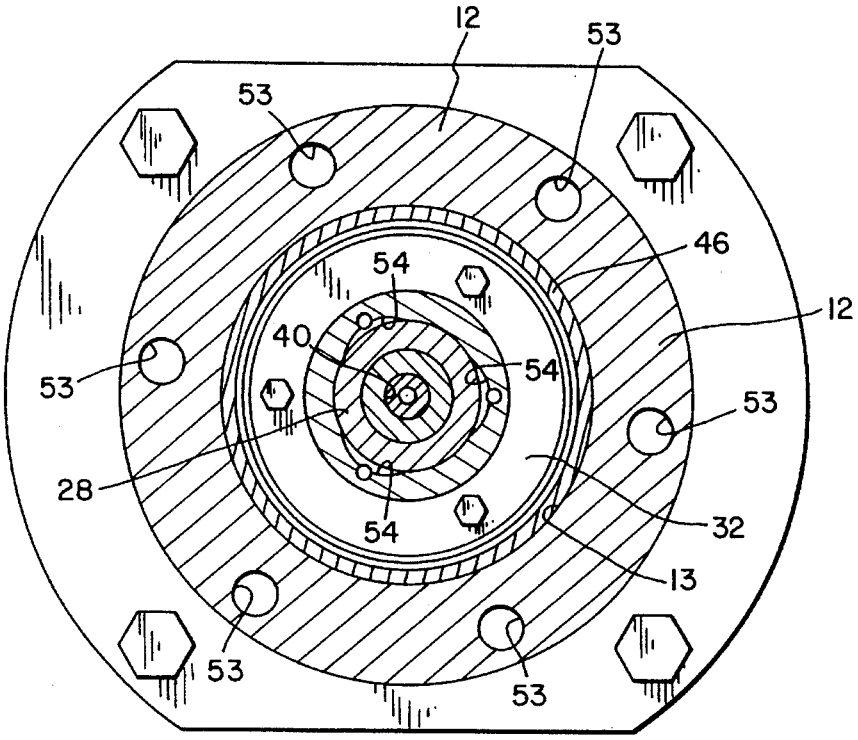
FIG. 3 is a sectional view of FIG. 1 taken along line 3—3 and viewed in the direction of the arrows.

Initial guiding of punch 28 is accomplished by hydrostatic pressure pads 44 formed about the circumference of redraw pressure pad 30 in the bottom portion 46 of housing 12. These pads 44 pressurized with fluid such as coolant, drawing compound or the like, and center redraw pressure pad 30 within tool pack housing 12. As shown in FIG. 2, at least three hydrostatic pads 44 are formed each approximately 120 degrees from each other about redraw pressure pad 30. A sealing ring 46 formed of metal is additionally disposed between redraw pressure pad 30 and tool pack housing 12 to confine the pressure created in hydrostatic pads 44. Hydraulic fluid fittings 48 conduct fluid under pressure from a pump or pressure source such as hydraulic pump 50 to pad areas 44. A pressure of 200 to 400 psi is preferred. A plurality of hydraulic lines 52 are utilized to conduct fluid under pressure from pump 50 to each fluid fitting 48, although several hydraulic lines 52 may be attached or manifolded together depending on how one would wish to control fluid flow. Only one hydraulic line 52 is shown in FIG. 1 to simplify the drawing. Alternatively, hydraulic passages 53 may be incorporated into the tool pack housing and run parallel with the main axis of punch 28. This guarantees that fluid pressure communicated to fluid fittings 48 is relatively equal at all fittings 48.

As shown in FIG. 2, additional hydrostatic pads 54 oriented 120 degrees from each other, are formed within redraw pressure pad 30 to guide punch 28 therethrough. Pads 54 receive pressurized fluid through passages 56 formed in pressure pad 30 and operatively associated with additional hydraulic fittings 48 disposed in tool pack housing 12.

Figure 6:
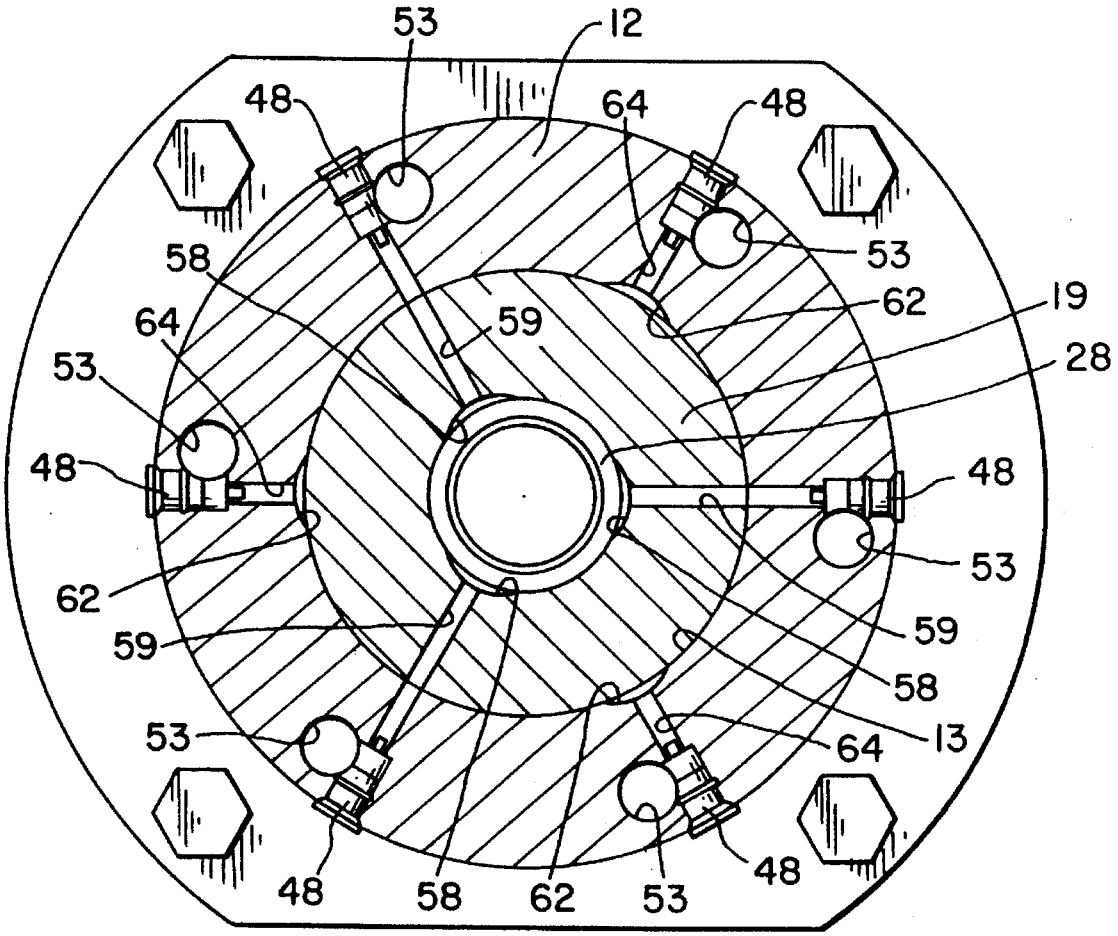
FIG. 6 is a sectional view taken along line 6—6 of FIG. 1 and viewed in the direction of the arrows.

Subsequent guiding of punch 28 is accomplished by hydrostatic pressure pads 58 formed within bores 26 of spacer rings 15, 17, 19, and 21 as shown in FIG. 6. These pressure pads 58 are disposed in the preferred embodiment at equidistant 120 degree positions to balance the force applied to punch 28. The fluid utilized in the hydrostatic pressure pads 58, as in the other hydrostatic pads described in this application, acts as a coolant to the hot cup and punch 28 while further acting as a lubricant. Passageways 59, passing through the spacer ring, operatively connects pressure pads 58 with a source of fluid and pressure, namely fluid fittings 48.

An additional feature, of one form of the invention, is that both the ironing rings (14, 16, 18, 20, 22) and spacer rings (15, 17, 19, 21) are themselves hydrostatically centered within tool pack housing 12 by hydrostatic pads 60 and 62, respectively.

Figure 5:
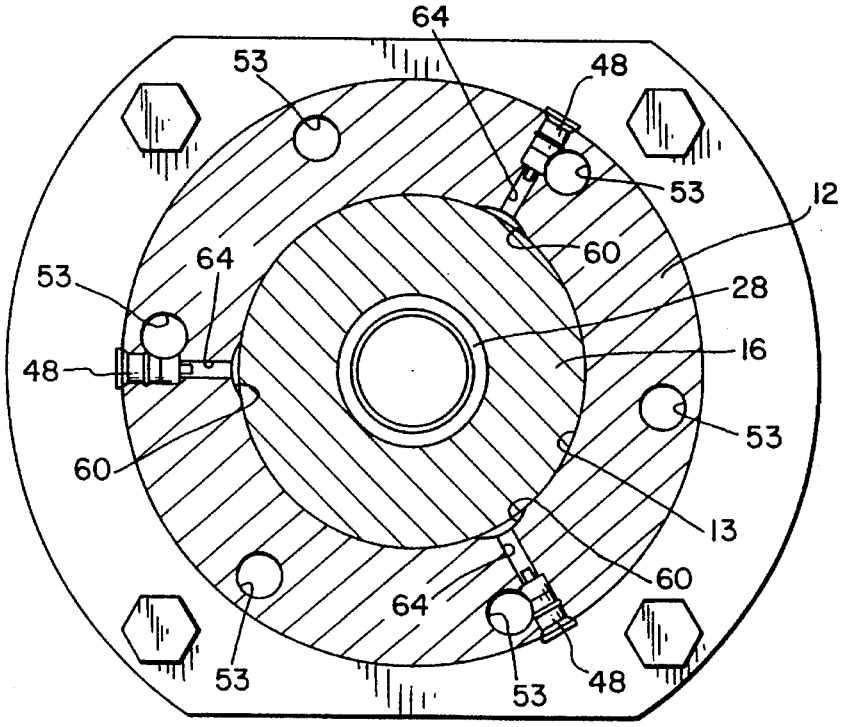
FIG. 5 is a sectional view of FIG. 1 taken along line 5—5 and viewed in the direction of the arrows.

As shown in FIG. 5, ironing ring 16, for example, is supported within tool pack housing 12 by hydrostatic pressure pads 60 disposed between sidewall 13 and the outer circumference of ironing ring 16. These pressure pads 60 are connected to fluid fittings 48 via fluid passageways 64 in tool pack housing 12. As shown in the FIG. 5, to properly center ironing rings within housing 12 at least three pads 60 are utilized 120 degrees apart. Other numbers and orientations of pads 60 may also be utilized.

An example of hydrostatic pressure pads 62 utilized to center the spacer rings is shown in FIG. 6. Spacer ring 19, for example, is supported within tool pack housing 12 by hydrostatic pressure pads 62 disposed between sidewall 13 and the outer circumference of spacer ring 19. These pressure pads 62, like pressure pads 60, are connected to fluid fittings 48 via fluid passageways 64 in tool pack housing 12. As shown in FIG. 6, to properly center spacer rings 19 within housing 12 at least three pads 62 are utilized 120 degrees apart, although other sizes and orientations of pads 62 may be utilized.

Figure 4:
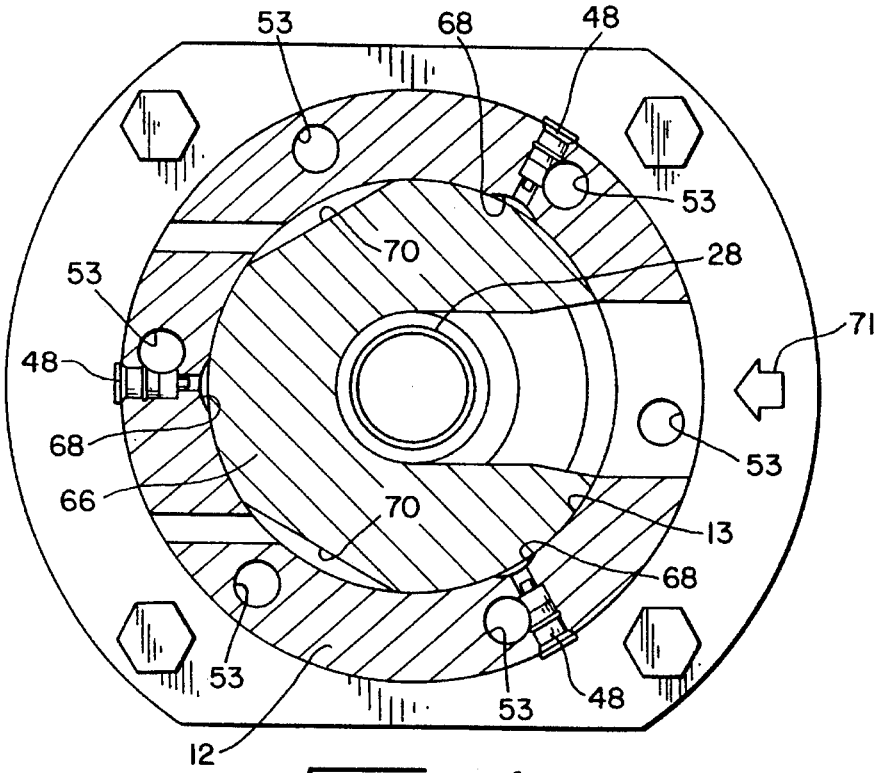
FIG. 4 is a sectional view taken along line 4—4 of FIG. 1 and viewed in the direction of the arrows.

Cup locator 66 is also hydrostatically "floated" within tool pack housing 12 by a plurality of hydrostatic pressure pads 68 disposed about the circumference of locator 66 and housing sidewall 13 (FIG. 4). Pads 68 are in fluid communication with fluid fittings 48 to receive the necessary pressurized fluid for proper alignment. Chamber 70 is for pressure relief to balance fluid loss caused by the opening at 71.

In operation, tool pack 10 will form a beverage can body similar to known bodymaker tool packs. A cup will be inserted, at the location indicated by arrow 71 (FIG. 1), into cup locator 66 just before punch 28 and redraw pressure pad 30 impact and hold cup against cup locator 66.

Punch 28 will continue to move forward through bores 24 and 26 thereby forming and stretching the cup as it passes through progressively smaller diameter ironing rings 14–22. As punch 28 approaches top portion 36, domer 34 and domer piston will form the can body bottom contour. After punch 28 has reached top dead center within tool pack 10 and begun retracting, the can body will be ejected out of an opening in housing 12 as indicated by arrow 72.

The hydrostatic pressure pads of the present invention cause all of the cup ironing rings, spacer rings, and cup locator to be precisely centered and coaxially aligned within tool pack housing 12. By totally hydrostatically guiding the punch and cup, friction created during forming is reduced. Heat created from friction during operation is also more easily tolerated since it is possible to circulate the fluid through tool pack housing to remove excess heat energy.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A tool pack for a bodymaker machine having a reciprocating punch for forming a workpiece in the form of a container, said tool pack comprising:

a plurality of ironing rings through which the punch reciprocates to form the workpiece;

a plurality of spacer rings interleaved between said ironing rings, each said spacer ring including a bore defined by a sidewall, the punch reciprocating through said bore; and hydrostatic bearings formed along said sidewalls, said hydrostatic bearings providing fluid pressure against said workpiece and punch to thereby guide the punch and workpiece through the tool pack during punch reciprocation.

2. The tool pack of claim 1 in which said hydrostatic bearings are formed by a plurality of recessed pad areas on each said sidewall.

3. The tool pack of claim 1 in which said hydrostatic bearings are formed by three recessed hydrostatic pads spaced at 120 degree intervals on each said sidewall.

4. The tool pack of claim 1 further including a housing, said ironing rings and said spacer rings disposed within said housing, said ironing rings supported within said housing by hydrostatic bearings formed between said housing and said ironing rings.

5. The tool pack of claim 4 in which said ironing ring hydrostatic bearings are formed by a plurality of recessed pads on an inside wall of said housing.

6. The tool pack of claim 1 further including a housing having an inside wall, said ironing rings and said spacer rings disposed within said housing, said spacer rings supported within said housing by hydrostatic bearings formed between said inside wall and said spacer rings.

7. The tool pack of claim 6 in which said spacer ring hydrostatic bearings are formed by a plurality of recessed hydrostatic pads on said spacer rings.

8. The tool pack of claim 1 in which the punch is vertically oriented for reciprocation.

9. A tool pack for a bodymaker machine having a reciprocating punch for forming a workpiece, said tool pack comprising:

a housing having an inside wall;

a plurality of ironing rings through which the punch reciprocates to form the workpiece;

a plurality of spacer rings interleaved between said ironing rings, each spacer ring including a bore formed by a sidewall, the punch reciprocating through said bores, said ironing rings and said spacer rings disposed within said housing; and a plurality of pressurized hydrostatic bearings formed along said inside wall between said housing and both said ironing rings and said spacer rings, whereby fluid pressure locates said ironing rings and said spacer rings within the tool pack housing.

10. The tool pack of claim 9 in which said hydrostatic bearings are formed by a plurality of recessed hydrostatic pads on said inside wall.

11. The tool pack of claim 9 in which each said hydrostatic bearing is formed by three recessed pads spaced at 120 degree intervals on said inside wall.

12. The tool pack of claim 9 in which the punch is vertically oriented for reciprocation.

13. The tool pack of claim 9 hydrostatic bearings formed along said spacer ring sidewalls, whereby fluid pressure guides the punch and workpiece through the tool pack.

14. The tool pack of claim 13 in which said punch hydrostatic bearings are formed by a plurality of recessed hydrostatic pads on said sidewall.

15. The tool pack of claim 13 in which said punch hydrostatic bearings are formed by three recessed hydrostatic pads spaced at 120 degree intervals on said sidewalls.

16. A bodymaker machine having a reciprocating punch for forming a workpiece and a tool pack, said tool pack comprising:

a housing having an inside wall;

a plurality of ironing rings through which the punch reciprocates to form the workpiece;

a plurality of spacer rings interleaved between said ironing rings, each spacer ring including a bore formed by a sidewall, the punch reciprocating through said bores, said ironing rings and said spacer rings forming a subassembly disposed within said housing;

a workpiece locator attached to said sub-assembly;

a redraw pressure member disposed in said housing for reciprocation relative to said workpiece locator, said redraw pressure member temporarily holding said workpiece to said workpiece locator when said redraw member is at top dead center, said redraw pressure member having a bore formed by a sidewall, the punch reciprocating through said redraw member bore; and a plurality of hydrostatic bearings formed along said inside wall between said housing and said redraw pressure member, whereby fluid pressure locates said redraw pressure member and said punch within the tool pack housing.

17. A container bodymaker machine including a reciprocating punch and a tool pack through which said punch reciprocates, said tool pack comprising:

a housing;

a plurality of axially spaced ironing rings in said housing through which said punch reciprocates; and a plurality of axially spaced punch hydrostatic bearings disposed between successive said ironing rings to exert fluid pressure on said punch and a workpiece carried thereby as said punch and workpiece advance axially through said tool pack to thereby guide and center the same.

18. The machine of claim 17 including a plurality of ironing ring hydrostatic bearings disposed radially between said housing and said ironing rings to center said rings in said housing.

19. The machine of claim 18 including a plurality of spacer rings axially interleaved with said ironing rings, said punch hydrostatic bearings being disposed on radially inner walls of said spacer rings.

20. The machine of claim 19 including a plurality of spacer ring hydrostatic bearings disposed radially between said housing and said spacer rings to center said spacer rings in said housing.

21. The machine of claim 17 including a plurality of spacer rings axially interleaved with said ironing rings, said punch hydrostatic bearings being disposed on radially inner walls of said spacer rings.

22. The machine of claim 21 including a plurality of spacer ring hydrostatic bearings disposed radially between said housing and said spacer rings to center said spacer rings in said housing.

* * * * *

UNITED STATES PATENT AND TRADEMARK OFFICE

CERTIFICATE OF CORRECTION

PATENT NO. : 5,555,761

DATED : Sept. 17, 1996

INVENTOR(S) : Roderick A. Lavy

It is certified that error appears in the above-identified patent and that said Letters Patent is hereby corrected as shown below: Item [57], In the Abstract, line 1, after --plurality--, insert --of--.

column 1, line 36, change --and--, to --an--.

column 2, line 22, after --disposed--, insert --a--.

column 3, line 54, after --44--, insert -- are--.

column 3, line 55, after --and--, insert -- similarly--.

Signed and Sealed this

Third Day of December, 1996

Bruce Lehman

*Attest:*

BRUCE LEHMAN

*Attesting Officer*

*Commissioner of Patents and Trademarks*